US009593481B2

(12) United States Patent
Gosling et al.

(10) Patent No.: US 9,593,481 B2
(45) Date of Patent: Mar. 14, 2017

(54) WALL-MOUNTED DEVICES, SYSTEMS, AND METHODS FOR SELECTIVELY POSITIONING OBJECTS

(71) Applicant: DIRTT Environmental Solutions, Ltd., Calgary (CA)

(72) Inventors: Geoff Gosling, Calgary (CA); Mogens Smed, DeWinton (CA)

(73) Assignee: DIRTT Environmental Solutions, LTD., Calgary (CA)

( * ) Notice: Subject to any disclaimer, the term of this patent is extended or adjusted under 35 U.S.C. 154(b) by 12 days.

(21) Appl. No.: 14/113,560

(22) PCT Filed: Jun. 10, 2013

(86) PCT No.: PCT/US2013/045024

§ 371 (c)(1),
(2) Date: Oct. 23, 2013

(87) PCT Pub. No.: WO2013/185141

PCT Pub. Date: Dec. 12, 2013

(65) Prior Publication Data

US 2015/0075086 A1 Mar. 19, 2015

Related U.S. Application Data

(60) Provisional application No. 61/657,792, filed on Jun. 9, 2012, provisional application No. 61/769,183, filed on Feb. 25, 2013.

(51) Int. Cl.
*E04B 2/74* (2006.01)
*A47B 57/06* (2006.01)
(Continued)

(52) U.S. Cl.
CPC ..... *E04B 2/7407* (2013.01); *A47B 5/00* (2013.01); *A47B 9/00* (2013.01); *A47B 57/06* (2013.01);
(Continued)

(58) Field of Classification Search
CPC ..... E04B 2/7407; E04B 2/7416; E04B 2/74; E04B 2/7401; E04B 2/7405; E04B 1/40;
(Continued)

(56) References Cited

U.S. PATENT DOCUMENTS 3,820,478 A * 6/1974 Bergenthal ..... 108/136
4,987,835 A * 1/1991 Schwartz et al. ..... 108/147
(Continued)

FOREIGN PATENT DOCUMENTS

JP 06-020429 6/1994
JP 06020429 6/1994
(Continued)

OTHER PUBLICATIONS

Translation of foreign document JP 07-000103Y2 (Itoki Crebio Corp) Jan. 11, 1995.*
(Continued)

*Primary Examiner* — Jessica Laux
(74) *Attorney, Agent, or Firm* — Workman Nydegger

(57) ABSTRACT

Implementations of the present invention relate to systems, methods, and apparatus for positioning and/or selectively repositioning one or more objects within an individual space. More specifically, a functional wall module can at least partially define the individual space. Furthermore, the functional wall module can include a single or multiple movable platforms that may support or secure one or more objects. As such, movement of the movable platform(s) may position and/or selectively reposition such objects within the individual space.

21 Claims, 8 Drawing Sheets

(51) Int. Cl.

| | |
|---|---|
| ***A47B 96/02*** | (2006.01) |
| ***E04B 1/41*** | (2006.01) |
| ***A47B 5/00*** | (2006.01) |
| ***A47B 9/00*** | (2006.01) |

(52) U.S. Cl.
CPC ..... *A47B 96/02* (2013.01); *E04B 1/40* (2013.01); *E04B 2/7422* (2013.01); *E04B 2002/7483* (2013.01); *E04B 2002/7488* (2013.01)

(58) Field of Classification Search
CPC ..... E04B 2002/4788; E04B 2002/7483; E04B 2/7422; A47B 2200/056; A47B 51/00; A47B 9/12; A47B 17/02; A47B 9/00; A47B 9/06; A47B 9/08; A47B 9/10; A47B 9/20; A47B 2009/006; A47B 2009/046; A47B 2009/065; A47B 2009/185; A47B 21/02; A47B 5/00; A47B 5/006; A47B 57/00; A47B 57/06; A47B 57/08; A47B 57/30; A47B 57/42; A47B 57/46; A47B 57/52; A47B 57/56; A47B 57/565; A47B 57/58; A47B 45/00; G10D 7/00; G10D 7/12; G10D 9/00; G10D 9/02
See application file for complete search history.

(56) References Cited

U.S. PATENT DOCUMENTS

| | | | | |
|---|---|---|---|---|
| 5,809,908 | A | 9/1998 | Catta et al. | |
| 8,424,983 | B1 * | 4/2013 | Strauss et al. | 312/247 |
| 2002/0059679 | A1 * | 5/2002 | Weismiller | A61G 7/002 5/610 |
| 2002/0171015 | A1 * | 11/2002 | Gosling | A47B 83/001 248/125.2 |
| 2012/0210949 | A1 * | 8/2012 | Polacek | A01K 13/00 119/756 |
| 2012/0248046 | A1 * | 10/2012 | Warner | 211/1.57 |

FOREIGN PATENT DOCUMENTS

| | | |
|---|---|---|
| JP | 07-000103 | 1/1995 |
| JP | 0700010 | 1/1995 |
| JP | 07-150758 | 6/1995 |
| JP | 07150758 | 6/1995 |
| KR | 102011012547 | 11/2011 |
| KR | 1020110125477 | 11/2011 |
| NL | 8204262 | 6/1983 |

OTHER PUBLICATIONS

Translation of foreign document JP 06-020429 Y2 (Itoki Crebio Corp) Jun. 1, 1994.*

International Search Report and Written Opinion for PCT/US2013/045024 mailed Jun. 10, 2013.

PCT International Search Report and Written Opinion for PCT/US2013/045024, dated Jun. 10, 2013. 16 Pages.

European Search Report for PCT/US2013/045024 dated Feb. 2, 2016.

* cited by examiner

WALL-MOUNTED DEVICES, SYSTEMS, AND METHODS FOR SELECTIVELY POSITIONING OBJECTS

CROSS-REFERENCE TO RELATED APPLICATIONS

The present invention is a 35 U.S.C. §371 U.S. National Stage of PCT Application No. PCT/US2013/045024 entitled "Wall-mounted Devices, Systems, and Methods for Selectively Positing Objects" filed Jun. 10, 2013, which claims priority to U.S. Provisional Patent Application No. 61/657,792, entitled "In-Wall System for Driving Adjustable Positioning of On-Wall Componentry" filed Jun. 9, 2012, and U.S. Provisional Patent Application No. 61/769,183, entitled "In-Wall System for Driving Adjustable Positioning of On-Wall Componentry" filed Feb. 25, 2013. The present invention claims the benefit of priority to U.S. Provisional Patent Application No. 61/864,786, entitled "Wall-Mounted Devices, Systems, And Methods For Selectively Positioning Objects," filed on Aug. 12, 2013. The entire content of each of the aforementioned patent applications is incorporated herein by reference.

BACKGROUND OF THE INVENTION

1. The Field of the Invention

This invention relates to systems, methods, and apparatus for selectively positioning objects near a wall or a similar surface.

2. Background and Relevant Art

A builder or installer may use modular walls to divide an open space within a building into individual spaces. Generally, modular walls may include a series of wall modules, which may connect to each other. The individual wall modules may be free-standing or rigidly attached to one or more support structures. In particular, a manufacturer or assembler can usually align and join the various wall modules together to divide an open space and form one or more individual spaces, such as an office, a room, a hallway, etc.

At least one advantage of modular walls is that they can be relatively easy to configure. In addition, modular wall systems can be less expensive to set up and can allow for reconfiguration more easily than permanent office dividers. For example, using modular wall systems, an installer may quickly form offices, conference areas, etc., in an undivided space of the building. If office space needs change, the users or occupants of the building may readily reconfigure the space and may at least partially reuse existing wall modules or modular walls.

Unfortunately, many conventional modular wall do not provide movable shelves, cabinets, work surfaces, etc. without requiring disassembly, repositioning, and reassembly of various components of the modular wall. Some conventional modular walls that automate movement of shelves, cabinets, etc., often require unsightly mechanisms that may interfere with selecting a position of such shelves or other components and the modular wall. Accordingly, there are a number of disadvantages in wall modules and modular walls that can be addressed.

BRIEF SUMMARY OF THE INVENTION

Implementations of the present invention provide systems, methods, and apparatus for positioning and/or selectively repositioning one or more objects within an individual space. More specifically, implementations include a functional wall module that has a single or multiple movable platforms, which may support or secure one or more objects. Movement of the movable platform(s) may selectively position and/or reposition such objects within the individual space. Furthermore, the functional wall module can at least partially form or define the individual space.

At least one implementation involves a functional wall module for at least partially forming an individual space in a building and for positioning and selectively repositioning one or more objects within the individual space. The functional wall module includes one or more vertical supports and one or more horizontal supports connected to at least one of the one or more vertical supports. In addition, the functional wall module includes one or more brackets slidably connected to at least one vertical support of the one or more vertical supports. Furthermore, the functional wall module includes a movable platform connected to or integrated with the one or more brackets, the movable platform having at least one support surface sized and configured to support the one or more objects. The functional wall module also includes a positioning mechanism connected to one or more of the one or more brackets or the movable platform, the positioning mechanism being configured to move the one or more brackets and the movable platform.

Additional or alternative implementations include a modular wall for creating an individual space and positioning and repositioning one or more objects within the individual space. Such modular wall includes one or more wall modules selectively and detachably connected together. The one or more wall modules include a first functional wall module including a frame and a first movable platform slidably connected to the frame. The first movable platform has at least one support surface sized and configured to support the one or more objects. Additionally, the first functional wall module includes a positioning mechanism having a movable portion and a stationary portion, the movable portion being connected to the first movable platform.

Implementations also include a reconfigurable individual space including a system for positioning and repositioning one or more objects therein. The individual space includes a first modular wall and a second modular wall detachably connected to the first modular wall. The second modular wall includes one or more functional wall modules. Each functional wall module includes a frame, a movable platform slidably connected to the frame, and a positioning mechanism secured near or within the frame. Moreover, the positioning mechanism is connected to the movable platform in a manner that activation of the positioning mechanism moves the movable platform.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. For better understanding, the like elements have been designated by like reference numbers throughout the various accompanying figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
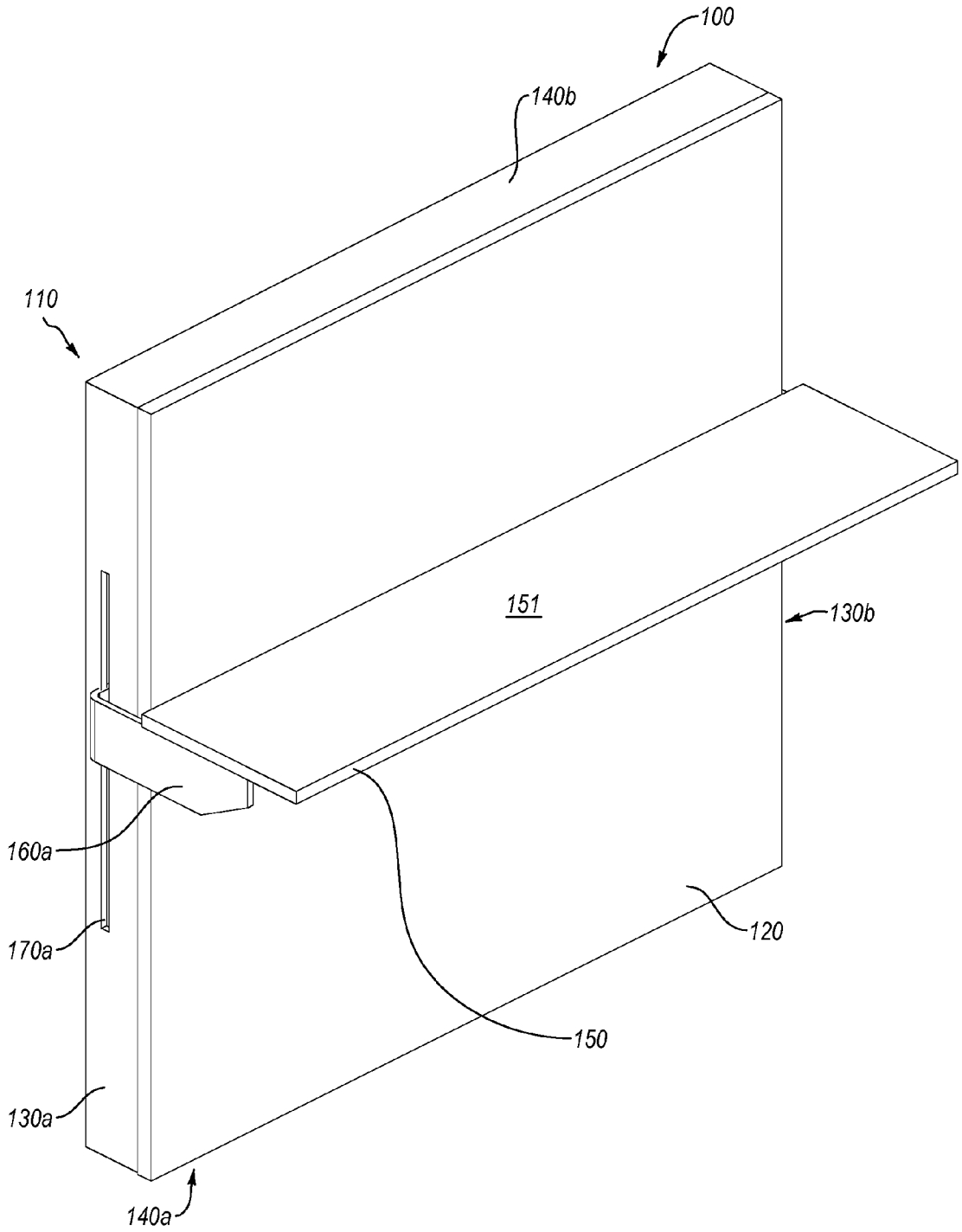
FIG. 1 illustrates a perspective view of a functional wall module in accordance with one implementation of the present invention.

Implementations of the present invention provide systems, methods, and apparatus for positioning and/or selectively repositioning one or more objects within an individual space. More specifically, implementations include a functional wall module that has a single or multiple movable platforms, which may support or secure one or more objects. Movement of the movable platform(s) may selectively position and/or reposition such objects within the individual space. Furthermore, the functional wall module can at least partially form or define the individual space.

For instance, multiple functional wall modules as well as nonfunctional wall modules may form a modular wall. Particularly, the functional and/or nonfunctional wall modules may selectively and detachably connect to one another in a manner that forms the modular wall. Moreover, the modular wall may subdivide an open space within a building and/or may define one or more individual spaces. Also, as mentioned above, the functional wall modules may include one or more movable platforms. For example, a user or occupant of the individual space may position the movable platform at a selected or chosen location on the functional wall module. Likewise, the user also may reposition the movable platform to a different selected location on the functional wall module.

Implementations also may include a drive or positioning mechanism that can position and/or reposition the movable platform on the functional wall. For instance, the positioning mechanism can facilitate automated or manual positioning and/or repositioning of the movable platforms. In one example, a user may position the movable platform at a desired location by pressing and/or holding a control button, which may activate the positioning mechanism. When activated, the positioning mechanism can move the movable platform in a selected direction.

The movable platform may include a support surface that can support one or more objects thereon. Generally, the movable platform can support any number of objects and may serve any number of purposes, which may vary from one implementation to the next. For example, the movable platform can provide a support surface similar to or the same as a shelf, a desk or a table, or any number of other support surfaces. Hence, in one instance, the movable platform can provide a writing and/or working surface for the user of the individual space.

In one or more implementations, the positioning mechanism can move the movable platform in a vertical direction (i.e., vertically relative to the functional wall module). For example, the movable platform can move upward or downward relative to the functional wall module. In additional or alternative implementations, the movable platform may move horizontally (e.g., parallel to the floor). Similar to the vertical movement, the horizontal movement of the movable platform also may be bidirectional, such that the movable platform may move in first and/or in second, opposition directions (e.g., to the left and to the right relative to the functional wall module).

The functional wall module can include cladding or panels, which may connect to a frame of the functional wall module. In an implementation, an installer or assembler may locate the positioning mechanism behind the panel of the functional module. For instance, the positioning mechanism may connect to the frame of the functional wall module, behind the panel (or between opposing panels), as described below in further detail. Thus, the panel(s) of the functional wall module can at least partially conceal the positioning mechanism (e.g., when the wall structure is viewed from certain perspectives). In any event, the positioning mechanism may operably connect to the movable platform in a manner that allows the positioning mechanism to move the movable platform relative to the functional wall module. Furthermore, a control mechanism can activate the positioning mechanism to move the movable platform on the functional wall module.

Referring now to the Figures, FIG. 1 illustrates a wall structure or functional wall module 100 according to an implementation of the present invention. The functional wall module 100 may include a frame 110 that can permanently or selectively or removably secure a panel 120. The panel 120 may conceal or cover an interior space of the frame 110. Accordingly, the panel 120 may have any suitable appearance or aesthetic, including colors, patterns, designs, etc.

In one implementation, the frame 110 may include sufficiently rigid material, which can support the frame 110 in an upright orientation. For example, the frame 110 may include aluminum (bar, extrusions, etc.), polymers, wood, etc. In any event, the material comprising the frame 110 may be sufficiently rigid and strong to support the panel 120 as well as other component or elements of the frame 110 in a desired orientation.

Generally, the panel 120 may comprise any suitable material, which may vary from one implementation to the next. In at least one implementation, the panel 120 may include rigid and/or resilient materials (similar to or the same as the materials used in or suitable for the frame 110). As such, the panel 120 may provide additional rigidity and/or support to the frame 110, when connected thereto. In alternative implementations, the panel 120 may include flexible or sheet-like material (such as fabric), which may conceal the interior of the frame 110 but may not provide any substantial support to the frame 110.

Additionally, the frame 110 or a portion thereof may connect to a frame (or a portion thereof) of another wall module. Hence, in at least one instance, the functional wall module 100 may couple to other functional or nonfunctional wall modules, which, together, may form a modular wall that defines one or more individual spaces. Alternatively or additionally, the functional wall module 100 may connect to a permanent wall or a structure in the building.

The frame 110 may include two opposing vertical supports 130*a*, 130*b* and two opposing horizontal supports 140*a*, 140*b*, which may interconnect together to form the frame 110. The panel 120 can connect to the vertical supports 130*a*, 130*b*, and/or to the horizontal supports 140*a*, 140*b*. It should be appreciated, however, that the frame 110 can include any number of vertical and/or horizontal supports, which may vary from one implementation to the next. Moreover, the vertical and/or horizontal supports of the frame 110 may connect one to another in any number of suitable configurations, thereby forming or defining the shape of the frame 110.

For example, as illustrated in FIG. 1, the frame 110 may have an approximately rectangular or square shape. In additional or alternative implementations, the frame 110 may have other shapes, such as triangular, trapezoidal, polygonal, etc. In any event, the vertical and horizontal supports (e.g., vertical supports 130*a*, 130*b*, horizontal supports 140*a*, 140*b*) may connect together to form the frame 110, which can secure the panel 120 thereto.

The panel 120 may connect to frame 110 to create or form a vertical wall surface. In one example, the panel 120 may permanently connect or couple to the frame 110. Alternatively, in at least one implementation, the panel 120 may removably and/or selectively connect to the frame 110. As such, the user may remove the panel 120 from the frame 110 (e.g., to service any elements or components of the functional wall module 100 located behind the panel 120) and may reconnect the panel 120 to the frame 110 thereafter.

Furthermore, the functional wall module 100 may incorporate any number of panels (similar to or the same as the panel 120). For example, the functional wall module 100 may include a second panel connected to the frame 110 opposite to the panel 120 (e.g., the panels may connect to front and back sides of the frame 110). Moreover, multiple panels may connect to the frame 110 on the same side thereof. In other words, the panel 120 or cladding on the front side of the frame 110 may include multiple segments connected to the frame 110. Similarly, the panel 120 may have a size and/or shape such that the panel 120 only partially covers the frame 110. In any case, the panel 120 may connect to the frame 110 and may at least partially conceal elements and/or components of the functional wall module 100.

In one or more implementations, the functional wall module 100 also may include a movable component, such as a movable platform 150. As described below in greater detail, the movable platform 150 may move vertically relative to the frame 110 and/or the panel 120. In additional or alternative implementations, the movable platform 150 may move horizontally relative to the frame 110 and/or the panel 120. Accordingly, the user may position the movable platform 150 at a desired location on the functional wall module 100. Thus, the movable platform 150 may position one or more objects supported or secured thereby at a desired location relative to the functional wall module 100.

More specifically, the movable platform 150 may include a support surface 151, which may carry one or more objects. Examples of the movable platform 150 include a shelf or shelving unit, a cabinet, a work surface, such as a desk top, and other components and support surfaces. Consequently, objects that the support surface 151 may support and move may include books, computer components (computer, monitor, etc.), phones, frames, etc. It should be appreciated that the above-described objects are only exemplary and not intended to limit the scope of this disclosure. Particularly, the movable platform 150 may support and/or move any number of suitable objects, which may vary from one implementation to another.

Moreover, in at least one implementation, the objects may connect to the movable platform 150 (e.g., to a side opposing to the support surface 151). In other words, the movable platform 150 may secure and carry objects that are not supported by the support surface 151 of the movable platform 150. For example, a curtain or a sheet of fabric may connect to the movable platform 150 in a manner that the movable platform 150 may move the curtain in a vertical direction, upward and/or downward.

As mentioned above, the movable platform 150 may movably or slidably connect to the frame 110. For instance, a bracket 160*a* may slidably connect the movable platform 150 to the frame 110. Implementations also may include multiple brackets (similar to or the same as the bracket 160*a*), which may slidably connect the movable platform 150 to the frame 110. In one implementation, the bracket 160*a* may slidably connect to the vertical support 130*a*. For example, the vertical support 130*a* may include a slot 170*a* that may accommodate and/or secure at least a portion of the bracket 160*a*, in a manner that the bracket 160*a* may slide within the slot 170*a*.

Figure 2B:
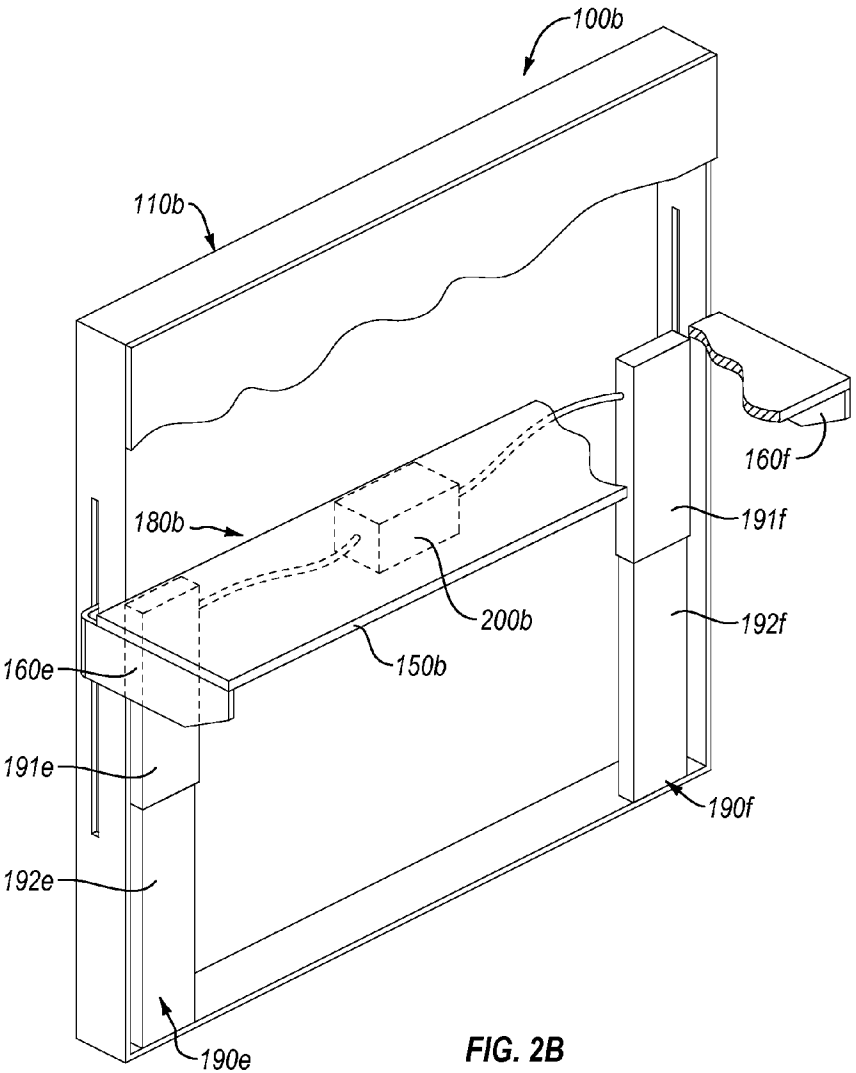
FIG. 2B illustrates a perspective view of a functional wall module with a partially exposed positioning mechanism in accordance with another implementation of the present invention.
Figure 2A:
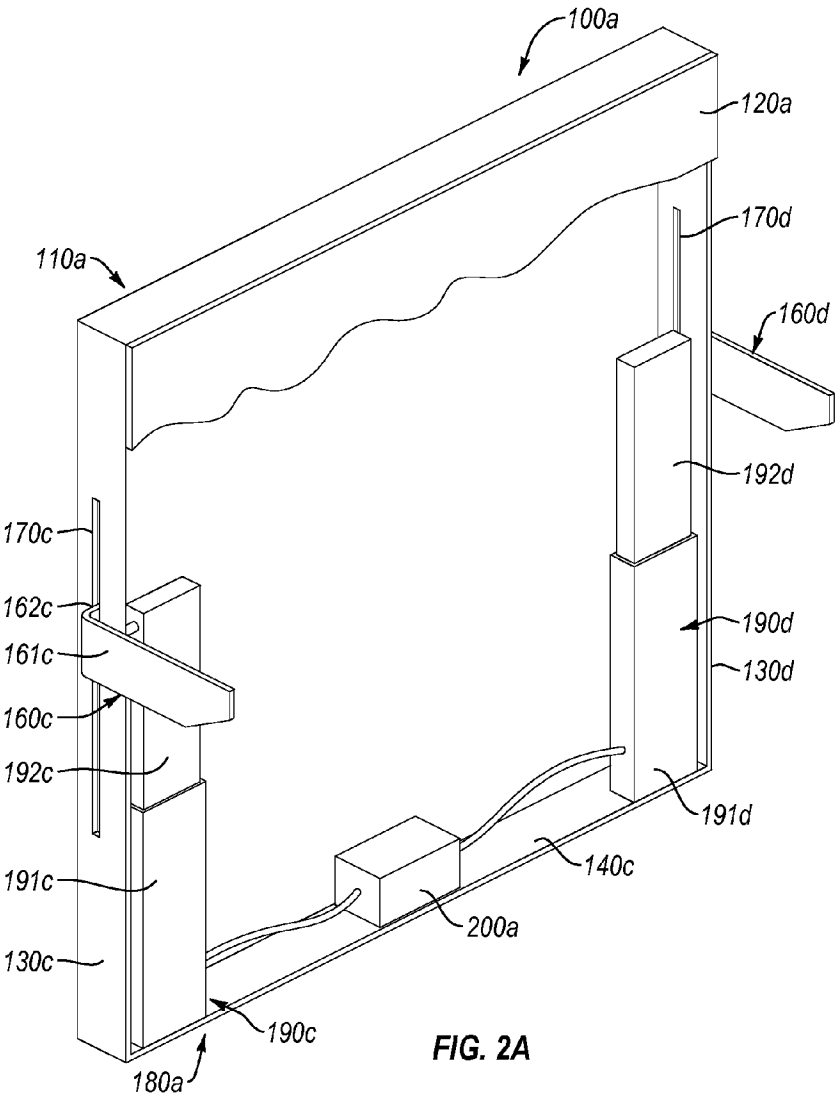
FIG. 2A illustrates a perspective view of a functional wall module with an exposed positioning mechanism in accordance with one implementation of the present invention.

In at least one implementation, as described below in more detail, the functional wall module may include two opposing brackets that may slidably connect the movable platform to the frame. For example, FIG. 2A illustrates a functional wall module 100*a* that includes first and second brackets 160*c*, 160*d* slidably connected to the respective vertical supports 130*c*, 130*d*. Except as otherwise described herein, the functional wall module 100*a* and its materials, components, and elements may be similar to or the same as the functional wall module 100 (FIG. 1) and any of its respective materials, components, and elements. For example, the functional wall module 100*a* may have a frame 110*a* that is similar to or the same as the frame 110 of the functional wall module 100 (FIG. 1). In an implementation, the vertical supports 130*c*, 130*d* may have corresponding slots 170*c*, 170*d*, which may accept a portion of the bracket 160*c* and of the bracket 160*d*, respectively.

For ease of description of the features, elements, and/or components of the brackets 160*c*, 160*d* as well as connections or interfaces of the brackets 160*c*, 160*d* with other elements or components of the functional wall module 100*a*, reference will be made only to the bracket 160*c*. It should be appreciated, however, that the bracket 160*d* can be similar to or the same as the bracket 160*c* (e.g., the bracket 160*d* may have mirrored but otherwise the same configuration as the bracket 160*c*). For instance, the bracket 160*c* may have a supporting portion 161*c* and a connecting portion 162*c*. In one or more implementations, the supporting portion 161*c* may connect to or be integrated with the connecting portion 162*c*. Moreover, the connecting portion 162*c* may have an approximately orthogonal orientation relative to the supporting portion 161*c*.

In additional or alternative implementations, the supporting portion 161*c* and the connecting portion 162*c* may have other suitable orientation relative to each other. For example, the supporting portion 161*c* may form an obtuse angle relative to the connecting portion 162*c*. In any event, as mentioned above, a portion of the bracket 160*c*, such as the connecting portion 162*c*, may pass through and/or be slidably secured within the slot 170*c*.

Accordingly, the width of the slot 170*c* can slidably accommodate the connecting portion 162*c* therein (e.g., the width of the slot 170*c* may be greater than the thickness of the connecting portion 162*c*). Similarly, the length of the slot 170*c* may be sufficient to allow the bracket 160*c* to move or slide within the slot 170*c* to a desired position and/or between desired positions relative to the frame 110*a*. For instance, the slot 170*c* located on the vertical support 130*c* may span vertically along the vertical support 130*c*, in a manner that allows the bracket 160*c* to slide within the slot 170*c* upward and/or downward.

The bracket 160*c* (or at least the connecting portion 162*c*) may have a width that is greater than thickness thereof. As such, the slot 170*c* may prevent the bracket 160*c* from rotating therein. In other words, the slot 170*c* and the bracket 160*c* may be sized and configured in a manner that the bracket 160*c* may slide along the length of the slot 170*c* but may not rotate within the slot 170*c*. More specifically, as noted above, the width of the slot 170*c* may provide a small clearance relative to the thickness of the connecting portion 162*c* of the bracket 160*c* (e.g., 0.005"), such that the connecting portion 162*c* may slide within the slot 170*c* but may not have sufficient clearance to rotate therein. Consequently, the bracket 160*c* and bracket 160*d* may support the movable platform (such as the movable platform 150 (FIG. 1)) in a manner that allows that the movable platform to move upward and downward along the slots 170*c*, 170*d*, while preventing or limiting the movable platform from rotating or tilting relative to the frame 110*a*.

Implementations also may include brackets that do not extend through slots in the frame but may simply extend out from a wall surface. For example, in a fixed wall system, a drive mechanism may be secured to a stud or another anchor point (e.g., behind a drywall surface). In such implementation, the brackets may extend through slots in the drywall surface.

Also, it should be appreciated that the brackets 160*c*, 160*d* (and thus the movable platform) may have any number of suitable connections with the frame 110*a*, which may vary from one implementation to the next. For instance, the frame 110*a* may include elongated members, such as rods, shafts, rails, etc., (connected thereto or integrated therewith). In addition, the brackets 160*c* and/or 160*d* may include one or more linear bearings, which may slidably couple to the elongated members and allow the brackets 160*c*, 160*d* to move or slide upward and downward (or in other chosen directions) relative to the frame 110*a*.

The brackets 160*c*, 160*d* may be selectively attachable to a number of different movable platforms. For example, any of the brackets 160*c*, 160*d* may secure a single movable platform that provides a work surface or a shelf. Moreover, the brackets 160*c*, 160*d* may secure multiple platforms (e.g., multiple shelves or shelving unit, cabinets, etc.). Implementation also may include brackets 160*c*, 160*d* that selectively connect to any part of the movable platform. For instance, any of the brackets 160*c*, 160*d* may connect to bottom, top, side, or back surfaces, or combinations thereof of the movable platform.

The functional wall module 100*a* also may include a positioning mechanism 180*a*. The positioning mechanism 180*a* may have any number of suitable actuators that may selectively adjust the position of the brackets 160*c*, 160*d* and of the movable platform. In one implementation, the positioning mechanism 180*a* includes two actuators 190*c*, 190*d* and a power source 200*a*. For example, the actuators 190*c*, 190*d* may be cylinders and can include corresponding cylinder barrels 191*c*, 191*d* and cylinder pistons 192*c*, 192*d*. The cylinder pistons 192*c*, 192*d* may extend outward and move linearly relative to the cylinder barrels 191*c*, 191*d*. Particularly, movement of the cylinder pistons 192*c*, 192*d* in a first direction can increase the overall length of the actuators 190*c*, 190*d*, while movement of the cylinder pistons 192*c*, 192*d* in a second direction can decrease the overall length of the actuators 190*c*, 190*d*.

Accordingly, connecting one of the cylinder barrels 191*c*, 191*d* or the cylinder pistons 192*c*, 192*d* to any of the brackets 160*c*, 160*d* and/or the movable platform, while maintaining the other of the cylinder barrels 191*c*, 191*d* or the cylinder pistons 192*c*, 192*d* stationary relative to the frame 110*a* can move the brackets 160*c*, 160*d* and the movable platform relative to the frame 110*a*. In one example, the cylinder pistons 192*c*, 192*d* can connect to the brackets 160*c*, 160*d* and the cylinder barrels 191*c*, 191*d* may remain stationary relative to the frame 110*a*. For instance, the cylinder barrels 191*c*, 191*d* may connect or couple to a horizontal support 140*c* of the frame 110*a*. In any case, the actuators 190*c*, 190*d* may move the brackets 160*c*, 160*d* upward by extending the cylinder pistons 192*c*, 192*d* in an upward direction and downward by retracting the cylinder pistons 192*c*, 192*d* in the downward direction. Furthermore, the cylinder pistons 192*c*, 192*d* may move to a selected position, which may be infinitely variable (within a particular range) along the length of the actuators 190*c*, 190*d*. Hence, for example, the actuators 190*c*, 190*d* may position the brackets 160*c*, 160*d* and the movable platform at any vertical location within the range of movement of the cylinder pistons 192*c*, 192*d*.

The actuators 190*c*, 190*d* may be actuated with pressurized fluid (e.g., air, hydraulic fluid, etc.), with electromagnetic actuation (e.g., a series of electromagnets that may be activated sequentially), etc. In addition, a builder or assembler may use many other types of actuators, including linear actuators, to move the brackets 160*c*, 160*d* and/or the movable platform. For example, the functional wall module 100*a* may include an actuator that has a motor operably connected to a linearly extending member (e.g., a rack and pinion). Moreover, implementations may include the functional wall module 100*a* that has a single actuator, such as the actuator 190*c* or another actuator.

In at least one implementation, the actuators 190*c*, 190*d* may be at least partially automated, which may allow the user to activate the actuators 190*c*, 190*d*, for instance, by depressing a control switch. In alternative implementations, the user may manually activate the actuators 190*c*, 190*d* to move the brackets 160*c*, 160*d*. Hence, the power source 200*a* may receive a signal or command to activate the actuators 190*c*, 190*d* and may provide such activation (e.g., by supplying fluid, electrical power, etc. to the actuators 190*c*, 190*d*). Alternatively, the power source 200*a* may receive manual input of energy to activate the actuators 190*c*, 190*d*. For example, the power source 200*a* may be a mechanical fluid pump (e.g., a foot pump). The user can manually operate the pump to supply pressurized fluid into the actuators 190*c*, 190*d*, thereby activating the actuators 190*c*, 190*d* and moving the cylinder pistons 192*c*, 192*d*.

In any case, however, the power source 200*a* may correspond with the particular actuator to provide necessary input to such actuator to move the brackets 160*c*, 160*d* and the movable platform. Generally, the power source 200*a* may control the movement of the actuators 190*c*, 190*d* to a selected position. For example, as noted above, for hydraulic cylinder type actuators, the power source 200*a* may initiate and/or regulate fluid flow into and out of such actuators. In another example, the power source 200*a* may supply power to electrical actuators, thereby moving the brackets 160*c*, 160*d* to a selected location. More specifically, the cylinder pistons 192*c*, 192*d* may move while the power is being supplied by the power source 200*a* and may stop when the power source 200*a* stops supplying power to the actuators.

Accordingly, a particular power source included in the functional wall module 100*a* may vary from one implementation to another. For example, the power source 200*a* may be a battery pack, which is in electrical communication with actuators 190*c* and/or 190*d*. Alternatively, the power source 200*a* may connect to an electrical outlet for power supply. In other words, the power source 200*a* and/or the control mechanism or controller (described below) can operate on AC power. Hence, the functional wall module 100*a* may be connected to a power outlet and may not require batteries. In any event, the power source 200*a* and the control mechanism can have a supply of power to active the actuators 190*c*, 190*d*, thereby raising or lowering the movable platform.

In addition, the cylinder pistons 192*c*, 192*d* as well as the brackets 160*c*, 160*d* may move upward and/or downward in a synchronized manner. As such, the movable platform may remain in an approximately unchanged orientation, as the movable platform moves along the frame 110*a*. For example, the movable platform may have an approximately parallel orientation relative to the support surface (e.g., relative to a floor) that supports the functional wall module 100*a*. Hence, the movable platform may move upward/downward relative to the floor, while maintaining an approximately parallel orientation relative thereto.

In at least one implementation, the power source 200*a* may connect or couple to the horizontal supports 140*c* (e.g., similar to the cylinder barrels 191*c*, 191*d*). Hence, the power source 200*a* may remain stationary relative to the frame 110*a*, while the brackets 160*c*, 160*d* may move upward/downward. For instance, the power source 200*a* may couple or be secured to any portion of the functional wall module 100*a* (e.g., to the frame 110*a*).

As mentioned above, the power source 200*a* may be a battery pack. It should be appreciated that, from time to time, the batteries may need replacement or recharging. Accordingly, in one instance, the power source 200*a* can be secured at a location accessible by a user. For example, the power source can couple to the movable platform (e.g., on a bottom surface thereof). Thus, when necessary, the user can access and replace the batteries from in the power source 200*a*. Moreover, as mentioned above, the panel 120*a* may removably connect to the frame 110*a*. As such, the user may remove the panel 120*a* from the frame 110*a* and, after replacing the batteries or otherwise servicing the functional wall module 100*a*, may reconnect the panel 120*a* to the frame 110*a*.

In at least one implementation, the panel 120*a* may span over the entire area or opening formed by the frame 110*a*. Alternatively, the panel 120*a* may cover only a portion of the area or opening formed by the frame 110*a*. Furthermore, the functional wall module 100*a* may include multiple panels that, together, may cover the entire area or opening formed by the frame 110*a*. In any event, implementations may include functional wall module 100*a* that has the panel 120*a*, which may at least partially hide or conceal the positioning mechanism 180*a* as well as components or elements thereof (e.g., actuators 190*c*, 190*d* and power source 200*a*). In other words, an assembler may secure the positioning mechanism 180*a* behind the panel 120*a*, so that the functional wall module 100*a* has a clean look.

In at least one implementation, the functional wall module 100*a* may include two opposing panels 120*a* (positioned on opposite sides of the frame 110*a*). As such, an assembler may locate the positioning mechanism 180*a* inside the frame 110*a* and between two, opposing panels 120*a*, thereby concealing the positioning mechanism 180*a* from two opposing sides of the functional wall module 100*a*. In other words, the positioning mechanism 180*a* may be completely hidden from view regardless of whether the functional wall module 100*a* is viewed from the front or the back.

Although, as described above, the power source 200*a* and/or the cylinder barrels 191*c*, 191*d* may remain unconnected from the brackets 160*c*, 160*d* and/or from the movable platform, this disclosure is not so limited. In one or more implementations, the power source may connect or couple to the brackets and/or to the movable platform. For example, as illustrated in FIG. 2B, a functional wall module 100*b* may include a movable platform 150*b* that can secure at least a portion of a positioning mechanism 180*b* of the functional wall module 100*b*. For example, the movable platform 150*b* may secure a power source 200*b* of the positioning mechanism 180*b*. Except as otherwise described herein, the functional wall module 100*b* and its materials, elements, or components may be similar to or the same as any of the functional wall modules 100, 100*a* (FIGS. 1-2A) and their respective materials, elements, or components.

For instance, similar to the functional wall module 100*a*, the power source 200*b* of the functional wall module 100*b* may actuate and/or power actuators 190*e*, 190*f*. In turn, the actuators 190*e*, 190*f* may move brackets 160*e*, 160*f* and the movable platform 150*b* (e.g., upward and/or downward). Hence, as the power source 200*b* may connect to the movable platform 150*b* and/or to the brackets 160*e*, 160*f*, the power source 200*b* may move together with the brackets 160*e*, 160*f* and the movable platform 150*b*.

Moreover, the actuators 190*e*, 190*f* may include cylinder barrels 191*e*, 191*f* and cylinder pistons 192*e*, 192*f* (similar to the actuators 190*c*, 190*d* (FIG. 2A)) Likewise, the power source 200*b* may be in operable communication with the actuators 190*e* and/or 190*f*, such that the power source 200*b* may actuate the actuators 190*e*, 190*f* and move the brackets 160*e*, 160*f* and the movable platform 150*b*. In at least one implementation, the power source 200*b* may operably connect to the cylinder barrels 191*e*, 191*f* of the actuators 190*e*, 190*f*, respectively, to actuate or activate the actuators 190*e*, 190*f*. As such, positioning the power source 200*b* near the cylinder barrels 191*e*, 191*f* may simplify installation of the functional wall module 100*b*. In any event, however, the power source 200*b* may activate the actuators 190*e*, 190*f*, which may position and reposition the brackets 160*e*, 160*f* and the movable platform 150*b* relative to the frame 110*b*.

Figure 3A:
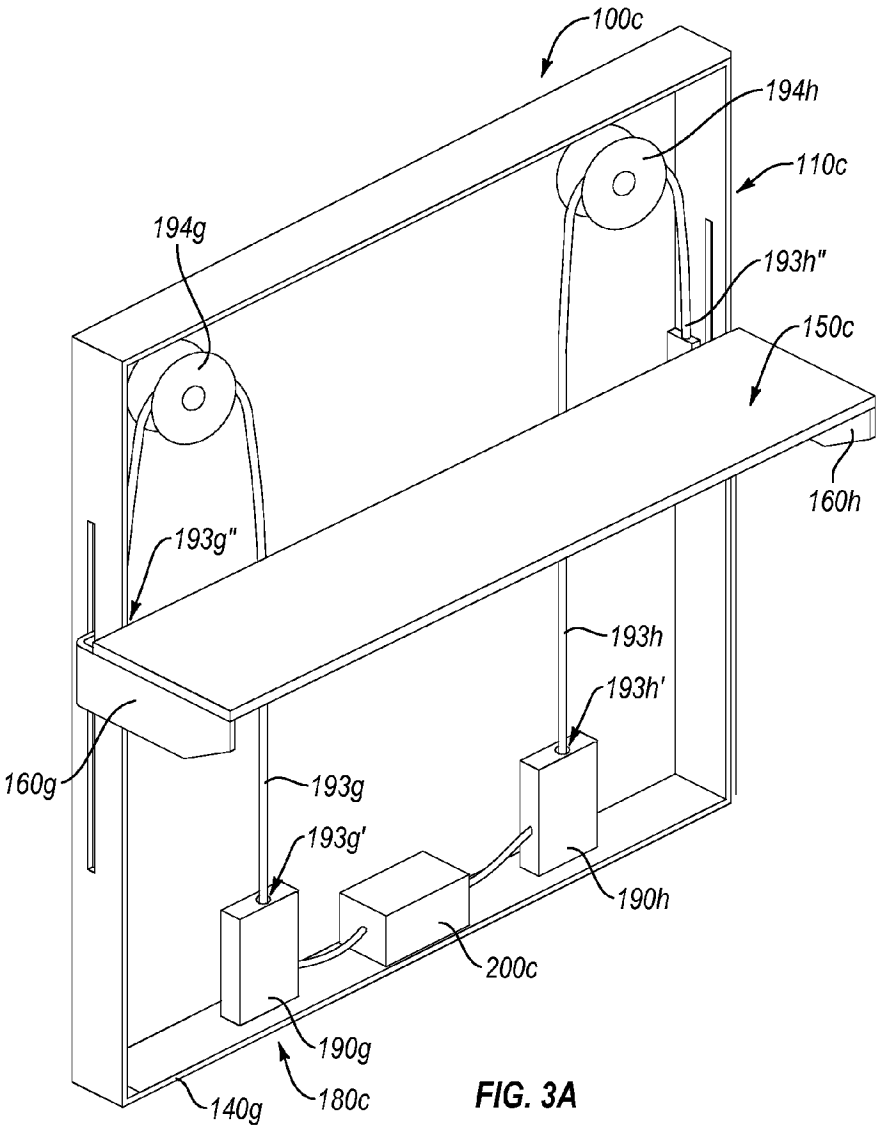
FIG. 3A illustrates a perspective view of a functional wall module with an exposed positioning mechanism in accordance with yet another implementation of the present invention.
Figure 3B:
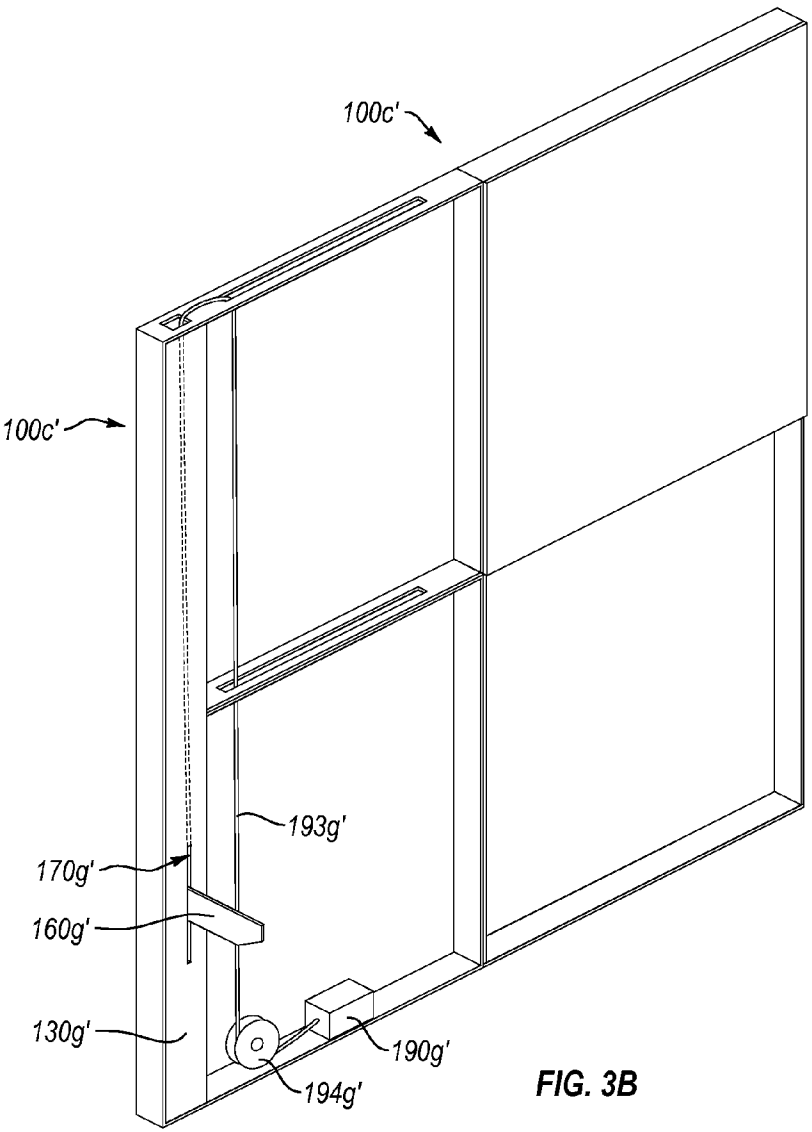
FIG. 3B illustrates a perspective view of a functional wall module with an exposed positioning mechanism in accordance with still another implementation of the present invention.
Figure 3C:
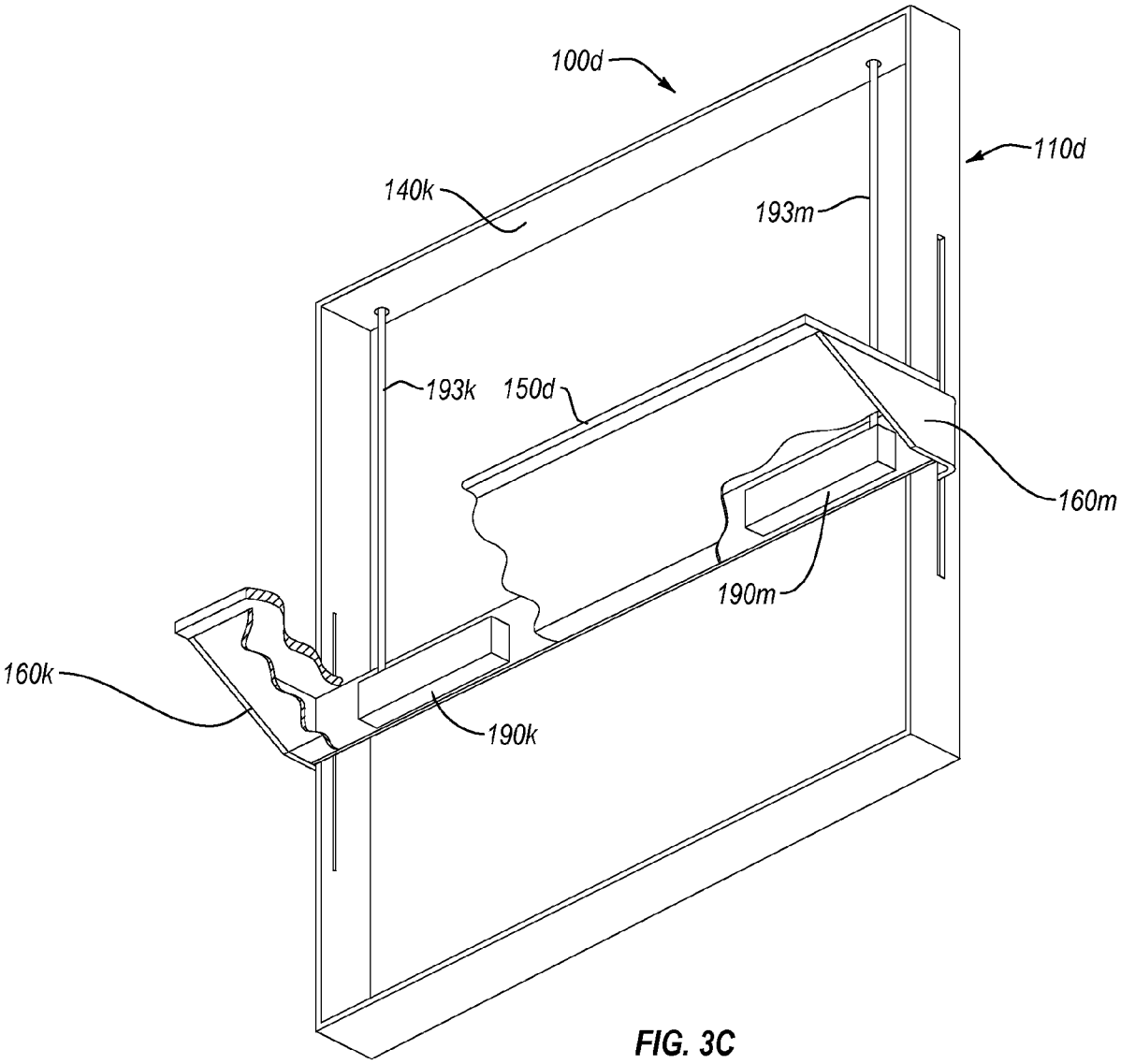
FIG. 3C illustrates a perspective view of a functional wall module with a partially exposed positioning mechanism in accordance with one or more additional or alternative implementations of the present invention.

In addition to securing the positioning mechanism and/or portions thereof at various suitable locations (e.g., on or near the functional wall module), the functional wall module also may incorporate any number of suitable positioning mechanisms, which may vary from one implementation to another. For instance, FIGS. 3A-3C illustrate examples of functional wall modules 100*c*, 100*c*', 100*d*, which include cable drive positioning mechanisms. Except as otherwise described herein, the functional wall modules 100*c*, 100*c*', 100*d* and their respective materials, components, or elements may be similar to or the same as one another as well as any of the functional wall modules 100, 100*a*, 100*b* (FIGS. 1-2B) and their respective materials, components, and elements. For example, the functional wall modules 100*c*, 110*c*', and 100*d* can include respective frames 110*c*, 110*c*', 110*d* and panels that can connect to the frames 110*c*, 110*c*' 110*d*.

In an implementation illustrated in FIG. 3A, the functional wall module 100*c* may include a cable drive positioning mechanism 180*c* operably connected to brackets 160*g*, 160*h*, movable platform 150*c*, or a combination thereof. Particularly, the positioning mechanism 180*c* may include actuators 190*g*, 190*h*, which can move the movable platform 150*c* upward and downward relative to the frame 110*c* of the functional wall module 100*c*. For instance, the actuators 190*g*, 190*h* may include retractable cables 193*g*, 193*h*, which may connect to any of the brackets 160*g*, 160*h*, the movable platform 150*c*, or a combination thereof. In one example, retracting the retractable cables 193*g*, 193*h* may raise the movable platform 150*c* upward, while letting out or extending the retractable cables 193*g*, 193*h* may lower the movable platform 150*c*.

Implementations may include the actuators 190*g*, 190*h* in operable connection with retractable cables 193*g*, 193*h*, respectively. More specifically, the retractable cables 193*g*, 193*h* can couple to the actuators 190*g*, 190*h* at first ends 193*g*', 193*h*' of the retractable cables 193*g*, 193*h*. The actuators 190*g*, 190*h*, in turn, may be positioned near a bottom of the frame 110*c* and may, in some instances, connect thereto (e.g., the actuators 190*g*, 190*h* may be secured to a horizontal supports 140*g* of the frame 110*c*). In one example, second ends 193*g*", 193*h*" of the retractable cables 193*g*, 193*h* can couple to the brackets 160*g*, 160*h*, movable platform 150*c*, or combinations thereof. Accordingly, the actuators 190*g*, 190*h* may selectively change a free length of the retractable cables 193*g*, 193*h* (i.e., the length between the first ends 193*g*', 193*h*' and second ends 193*g*", 193*h*"), thereby raising and lowering the movable platform 150*c*.

Thus, the actuators 190*g*, 190*h* can be configured to retract the retractable cables 193*g*, 193*h*. In other words, when actuated, the actuators 190*g*, 190*h* can shorten the free lengths of the retractable cables 193*g*, 193*h*. As the actuators 190*g*, 190*h* shorten the free lengths of the retractable cables 193*g*, 193*h*, the actuators 190*g*, 190*h* may raise the brackets 160*g*, 160*h* and the movable platform 150*c* relative to the frame 110*c*. The actuators 190*g*, 190*h* also may at least partially store or house the retracted portions of the retractable cables 193*g*, 193*h*.

For example, the actuators 190*g*, 190*h* can include a motor and a spool coupled to the motor. Particularly, the motor can rotate the spool in the clockwise and/or counterclockwise directions. The retractable cables 193*g*, 193*h* can couple to the spool (e.g., at the first ends 193*g*', 193*h*') in a manner that the spool can wind the retractable cables 193*g*, 193*h*. Accordingly, when activated, the motor can wind the retractable cables 193*g*, 193*h* onto the spool, thereby shortening the free length of the retractable cables 193*g*, 193*h* and raising the brackets 160*g*, 160*h* and the movable platform 150*c*.

Additionally, the actuators 190*g*, 190*h* also can let out or lengthen the retractable cables 193*g*, 193*h*. Thus, as the actuators 190*g*, 190*h* let out the retractable cables 193*g*, 193*h*, the brackets 160*g*, 160*h*, and the movable platform 150*c* may lower relative to the frame 110*c*, under the gravitational pull. As such, the actuators 190*g*, 190*h* can retract and let out retractable cables 193*g*, 193*h*, thereby moving the brackets 160*g*, 160*h*, and the movable platform 150*c* upward and downward, respectively.

Also, implementations may include the functional wall module 100*c* that has one or more pulleys, such as pulleys 194*g*, 194*h*. The pulleys 194*g*, 194*h* can guide and at least partially secure the retractable cables 193*g*, 193*h*. As noted above, in some instances, the assembler may place the actuators 190*g*, 190*h* near the bottom of the frame 110*c*. Hence, the pulleys 194*g*, 194*h* can allow the retractable cables 193*g*, 193*h* to change direction (e.g., from upward to downward), thereby facilitating securing the second ends 193*g*", 193*h*" of the retractable cables 193*g*, 193*h* to the brackets 160*g*, 160*h*. Moreover, the pulleys 194*g*, 194*h* may rotate about an axis as the retractable cables 193*g*, 193*h* moves relative to such axis. Accordingly, rotation of the pulleys 194*g*, 194*h* may reduce friction associated with the movement of the retractable cables 193*g*, 193*h* about a non-rotating pivot point.

In at least one implementation, a power source 200*c* can be in electric communication with the actuators 190*g*, 190*h*. Specifically, as described above, the power source 200*c* can supply power to and activate the actuators 190*g*, 190*h*. Accordingly, selective activation of the actuators 190*g*, 190*h* can selectively position the movable platform 150*c* at a desired location relative to the frame 110*c*. For example, as further described below, a controller can direct the power source 200*c* to activate and/or deactivate the actuators 190*g*, 190*h* to position and/or reposition the movable platform 150*c* on the functional wall module 100*c*.

In one or more implementations, the functional wall module 100*c* can include a locking mechanism, which can secure the brackets 160*g*, 160*h* and/or the movable platform 150*c* at a desired height. That is, after the actuators 190*g*, 190*h* position the movable platform 150*c* at a desired height, the locking mechanism can maintain the movable platform 150*c* at such height. For instance, as described below, such locking mechanism can be integrated with or incorporated into the actuators 190*g*, 190*h*. Additionally or alternatively, the locking mechanism can be separate from the actuators 190*g*, 190*h*.

In one example, the actuators 190*g*, 190*h* can include a clutch or a brake that can prevent or limit rotation of the spool. Such clutch, for example, can engage the spool when the motor is stationary and may disengage from the spool when motor rotates (e.g., at a predetermined number of revolutions per minute). In additional or alternative implementations, the actuators 190*g*, 190*h* can include ratcheting or other locking mechanisms. In any case, the locking mechanism, whether incorporated or integrated with the actuators 190*g*, 190*h* or separate therefrom, can secure the movable platform 150*c* at a desired height.

It should be also noted that, although the reference herein is made to two actuators 190*g*, 1990*h*, the functional wall module 100*c* can include any number of linear actuators and/or positioning mechanisms. For instance, in at least one implementation, the functional wall module 100*c* includes a single linear actuator, which can raise and lower the movable platform. Moreover, although the reference herein is made to linear actuators, it should be appreciated that any number of actuators may be used to produce desired (e.g., linear) movement of the movable platform along the frame 110*c*.

Additionally or alternatively, as illustrated in FIG. 3B, the functional wall module 110*c*' may include a slot 170*g*' through a front-facing portion of the a vertical support 130*g*'. As such, a bracket 160*g*' may have a substantially planar or straight configuration (i.e., the connecting and supporting portions of the bracket 160*g*' may be parallel to each other). It should be appreciated that, as noted above, the functional wall module 100*c*' may include any number of brackets, which independently or together may secure the movable platform.

Also, the functional module 100*c*' may include a retractable cable drive positioning mechanism, similar to the positioning mechanism of the functional module 100*c* (FIG. 3A). In the present implementation, however, the positioning mechanism of the functional module 100*c*' may include a retractable cable 193*g*' that may have multiple direction changes between an actuator 190*g*' and the bracket 160*g*'. Particularly, a first portion of the retractable cable 193*g*' may extend from the actuator 190*g*' in first direction (e.g., away from the actuator 160*g*' and toward the bracket 160*g*'). Thereafter, a second portion of the retractable cable 193 may extend upward or toward an upper portion of the frame 110*c*' (e.g., at a 90° angle relative to the first portion). Moreover, the retractable cable 193*g*' may have another directional change along the third portion thereof, which may extend downward, toward the bracket 160*g*'. In some instances, the second and third portions of the retractable cable 193*g*' may be approximately parallel to each other and may move in opposite directions when the retractable cable 193' is retracted or let out by the actuator 190*g*'. Additionally, the functional wall module 100*c*' may include any number of actuators and retractable cables, which may extend from the actuators to the brackets and/or to the movable platform(s) in any number of directions and may change direction any number of times between the actuators and the respective brackets and/or movable platform(s).

Furthermore, the actuators (whether linear or otherwise) may connect at any number of suitable locations on or near the frame of the wall module. For example, as illustrated in FIG. 3C, implementations may include the functional wall module 100*d* that has actuators 190*k*, 190*m* that may connect to a movable platform 150*d* (e.g., the actuators 190*k*, 190*m* can bolt to the movable platform 150*d*). Similar to the wall modules described above, the functional wall module 100*d* may include bracket 160*k*, bracket 160*m* that may slidable or movably connect the movable platform 150*d* to the frame 110*d*.

In one example, the actuators 190*k*, 190*m* may connect to respective retractable cables 193*k*, 193*m*. Specifically, first ends of the retractable cables 193*k* 193*m* may operably connect to the actuators 190*k*, 190*m*, respectively. In addition, second ends of the retractable cables 193*k*, 193*m* can connect to the frame 110*d*. For instance, the second ends of the retractable cables 193*k*, 193*m* can couple to an upper portion of the frame 110*d* (e.g., the second ends of the retractable cables 193*k*, 193*m* may connect to a horizontal support 140*k*). In other implementations, the free ends of the retractable cables 193*k*, 193*m* can couple or be secured to other components or elements that may remain stationary relative to the movable platform 150*d*. In any event, however, upon actuation, the actuators (e.g., actuators 190*k*, 190*m*) can reposition the movable platform 150*d*.

Furthermore, the actuators 190*k*, 190*m* can have any number of suitable orientations and positions on the movable platform 150*d*. For instance, the as shown in FIG. 3C, the actuators 190*k* 190*m* can be oriented horizontally (e.g., in a manner that minimizes protrusion of the actuators 190*k*, 190*m* away from the movable platform 150*d*. In one implementation, the actuators 190*k*, 190*m* can connect to a bottom surface of the movable platform 150*d*. Consequently, in some instances, the actuators 190*k*, 190*m* can be concealed under the movable platform 150*d*. For example, positioning the movable platform 150*d* at a height that approximates the user's waist, can conceal the actuators 190*k*, 190*m* under the movable platform 150*d*, even when viewed from a distance.

Additionally, actuators 190*k*, 190*m* can be concealed by a single cover, which can span across the movable platform 150*d*. For example, a single cover can conceal any number of actuators (e.g., actuators 190*k*, 190*m*) or portions thereof under the movable platform 150*d*. Moreover, in one or more implementations, the cover can include a taper that gradually reduces the thickness of the cover relative to the bottom surface of the movable platform 150*d*. In some instances, the cover can at least partially blend in with the bottom surface of the movable platform, thereby concealing the actuators from a viewer. In other words, the one or more actuators (e.g., actuators 190*k*, 190*m*), which can move the movable platform 150*d* relative to the frame 110, can be concealed by the moveable platform 150*d* and/or by the cover that can blend in with the movable platform.

In any event, the actuators 190*k*, 190*m* may connect to any of the movable platform 150*d* and/or the brackets 160*k*, 160*m*. Thus, the actuators 190*k*, 190*m* also may provide additional weight for the movable platform 150*d* to slide in the downward direction. Hence, the brackets 160*k*, 160*m* and the movable platform 150*d* can move together with the actuators 190*k*, 190*m* in the upward and/or downward direction.

Figure 4A:
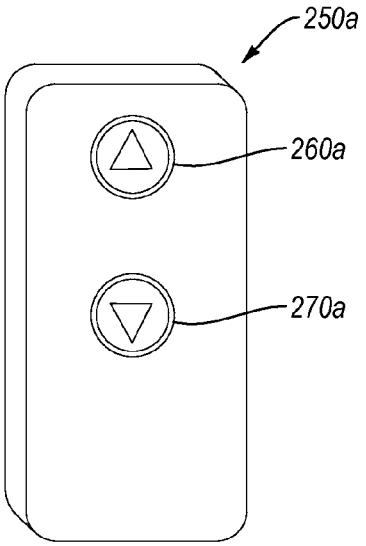
FIG. 4A illustrates a perspective view of a controller for a functional wall module in accordance with one implementation of the present invention.

As mentioned above, the functional wall module may include a control mechanism or a controller, which can direct the power source and/or the positioning mechanism to position and/or reposition the movable platform at a selected location. One exemplary controller 250*a* is illustrated in FIG. 4A. Particularly, the controller 250*a* may be a wireless controller, which may wirelessly signal the power supply to activate the actuators that may position and reposition the movable platform.

For instance, the controller 250*a* may include one or more input devices or inputs, such as an "up" button 260*a* and a "down" button 270*a*. Pressing the "up" button 260*a* may cause the movable platform to move upward. Conversely, pressing the "down" button 270*a* may cause the movable platform to move downward.

One of skill in the art will recognize that there are a number of different wireless communication mechanisms or systems that may be used to connect or couple the controller 250*a* with the power source in a manner that will allow the controller 250*a* to send wireless signals to the power source. For example, the controller 250*a* may communicate with the power source via radio frequency identification ("RFID") signals, infrared signals, or another wireless transmission signal. It should be appreciated that the power source may include a suitable receive configured to receive signals from the controller 250*a*.

As described above, the movable platform may move relative to the frame of the functional wall module in any number of directions. Hence, the controller may include any number of suitable inputs, which may cause the movable platform to move in directions corresponding to such inputs. Moreover, configuration and/or layout of the inputs on the controller may vary from one implementation to another. For example, inputs may be configured as one or more flip switches, rheostats (e.g., rotatable rheostats, scrolling rheostats, etc.), potentiometers, touch sensitive controls, voice activated controllers, and the like.

Figure 4B:
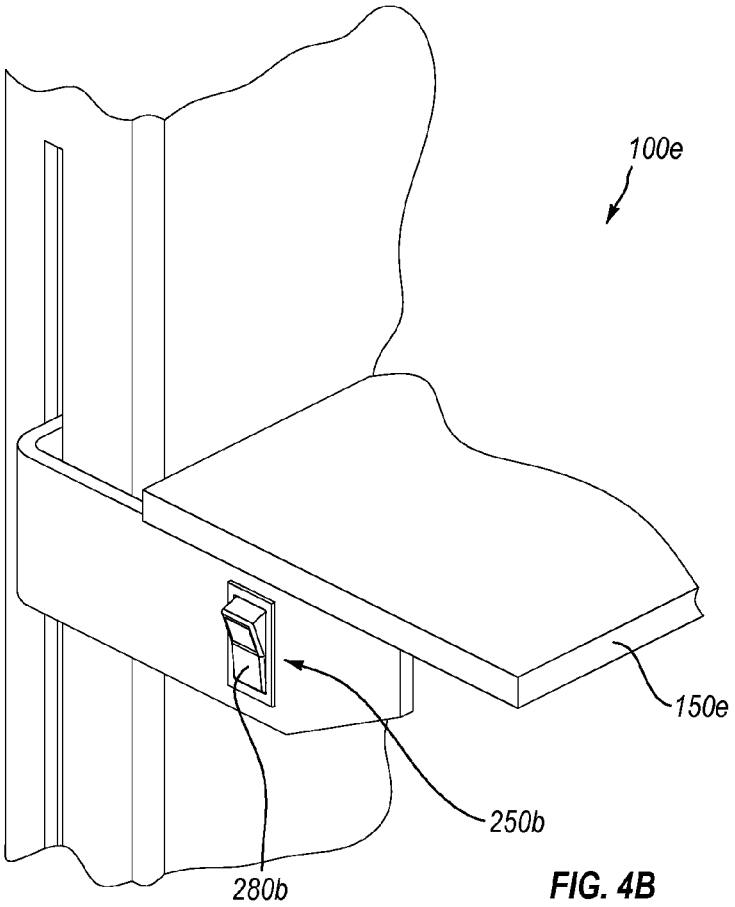
FIG. 4B illustrates a partial perspective view of a functional wall module with an integrated controller in accordance with one or more implementations of the present invention.

Alternatively or in addition, a controller may communicate with the power source via a wired communication connection. For example, FIG. 4B illustrates a partial view of a functional wall module 100*e* that includes a wired controller 250*b*. The functional wall module 100*e* and its materials, elements, or components can be similar to or the same as any of the functional wall modules 100, 100*a*, 100*b*, 100*c*, 100*d* (FIGS. 1-3C) and their respective materials, elements, and components. For instance, the functional wall module 100*e* may include a movable platform 150*e* that can be the same as any of the movable platforms of the functional wall modules 100, 100*a*, 100*b*, 100*c*, 100*d* (FIGS. 1-3C).

The wire that connects the controller 250*b* to the power source may be at least partially hidden from view (e.g., the wire may extend behind the bracket and/or panels of the functional wall module 100*e*. In one implementation, the controller 250*b* may be secured to the bracket and may move together with the bracket and the movable platform 150*e*. Generally, however, the controller 250*b* may be secured anywhere on or near the functional wall module 100*e*. For instance, the controller 250*b* may be secured to the frame and/or to the panel of the functional wall module 100*e*.

The controller 250*b* also may include an input switch 280*b*. In one example, the input switch 280*b* may be moved in one or more directions to cause the movable platform 150*e* to move in either corresponding directions. For example, moving the input switch 280*b* upward may cause the movable platform 150*e* to move upward, while moving the input switch 280*b* downward may cause the movable platform 150*e* to move downward.

Figure 5:
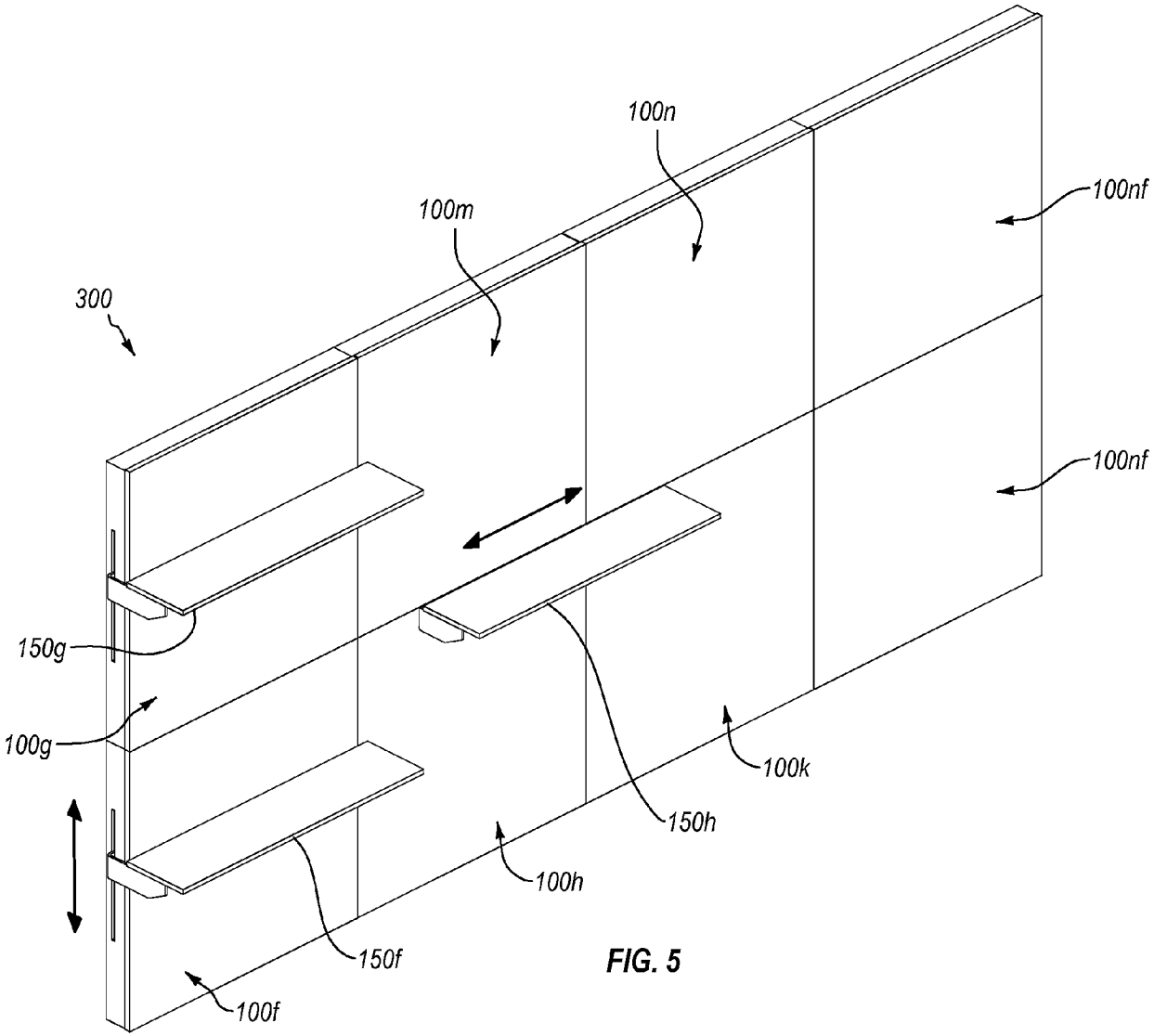
FIG. 5 illustrates a perspective view of a modular wall in accordance with one implementation of the present invention.

In addition, the assembler may connect multiple functional and/or nonfunctional wall modules to form various wall structures or modular walls. Such modular walls may include a single or multiple movable platforms that can be selectively positioned and repositioned. For example, FIG. 5 illustrates a modular wall 300 that includes functional wall modules 100*f*, 100*g*, 100*h*, 100*k*, 100*m*, 100*n* and nonfunctional wall modules 100*nf*. Except as described herein, the functional wall modules 100*f*, 100*g*, 100*h*, 100*k*, 100*m*, 100*n* and their respective materials, elements, or components can be similar to or the same as one another as well as any of the functional wall module 100, 100*a*, 100*b*, 100*c*, 100*d*, 100*e* (FIGS. 1-3C, 4B) and their respective materials, elements, and components.

For instance, the functional wall module 100*f* and functional wall module 100*g* can include movable platforms 150*f*, 150*g*, respectively, which may move in upward and/or downward directions. In an implementation, a single positioning mechanism may move both of the movable platforms 150*f*, 150*g* together. In other words, the movable platforms 150*f*, 150*g* may move together upward or downward. In additional or alternative implementations, each of the movable platforms 150*f*, 150*g* may have a separate positioning mechanism. As such, the movable platforms 150*f*, 150*g* may move independently of one another. Also, movable platforms 150*f*, 150*g* may share a single positioning mechanism and move together but in different directions.

In addition, the functional wall modules 100*h*, 100*k*, 100*m*, 100*n* may include a movable platform 150*h* that may move in a horizontal direction (e.g., to the left and/or to the right relative to the modular wall 300). The movable platform 150*h* may slidably connect to one or more frames of the functional wall modules 100*h*, 100*k*, 100*m*, 100*n* in a manner that allows the movable platform 150*h* to move in a horizontal direction relative thereto. It should be appreciated that the brackets or other components or elements that may slidably or movably connect the movable platforms 150*f*, 150*g*, and/or 150*h* to respective functional wall modules may pass between the frames and panels of the adjacent functional and (in some instances) nonfunctional wall modules.

Also, as described above, any of the functional wall modules 100*f*, 100*g*, 100*h*, 100*k*, 100*m*, 100*n* may detachably or non-detachably connect to any other functional wall module and/or to any of the nonfunctional wall modules 100*nf*. For example, the functional wall module 100*f* may connect to the adjacent functional wall module 100*h*. Similarly, the functional wall module 100*k* may connect to the adjacent nonfunctional wall module 100*nf*.

Moreover, implementations may include partial height (e.g., half height) functional wall modules 100*f*, 100*g*, 100*h*, 100*k*, 100*m*, 100*n* and/or partial height nonfunctional wall modules 100*nf*. For instance, multiple wall modules may stack one on top of another to define the height of at least a portion of the modular wall 300. In one example, the functional wall module 100*g* may stack on top of the functional wall module 100*f*. Alternatively, any of the functional wall modules 100*f*, 100*g*, 100*h*, 100*k*, 100*m*, 100*n* as well as the nonfunctional wall modules 100*nf* may be full height wall modules (e.g., may form or define the entire height of at least a portion of the modular wall 300). In one implementation, full height wall modules may span from a floor approximately to a ceiling of a building space.

One will appreciate that the modular walls and functional wall modules (generally) may benefit users in a wide variety of applications, including applications that require movement of on-wall componentry or objects. For example, the modular walls of the present invention may at least partially define or form classrooms, offices, retail space, etc. The modular walls of the present invention also may be particularly suitable to retail businesses, such as stores that have shelving units that hold products for sale. Shelving units could be moved to accommodate the size of the products and to maximize use of the wall space.

Figure 6:
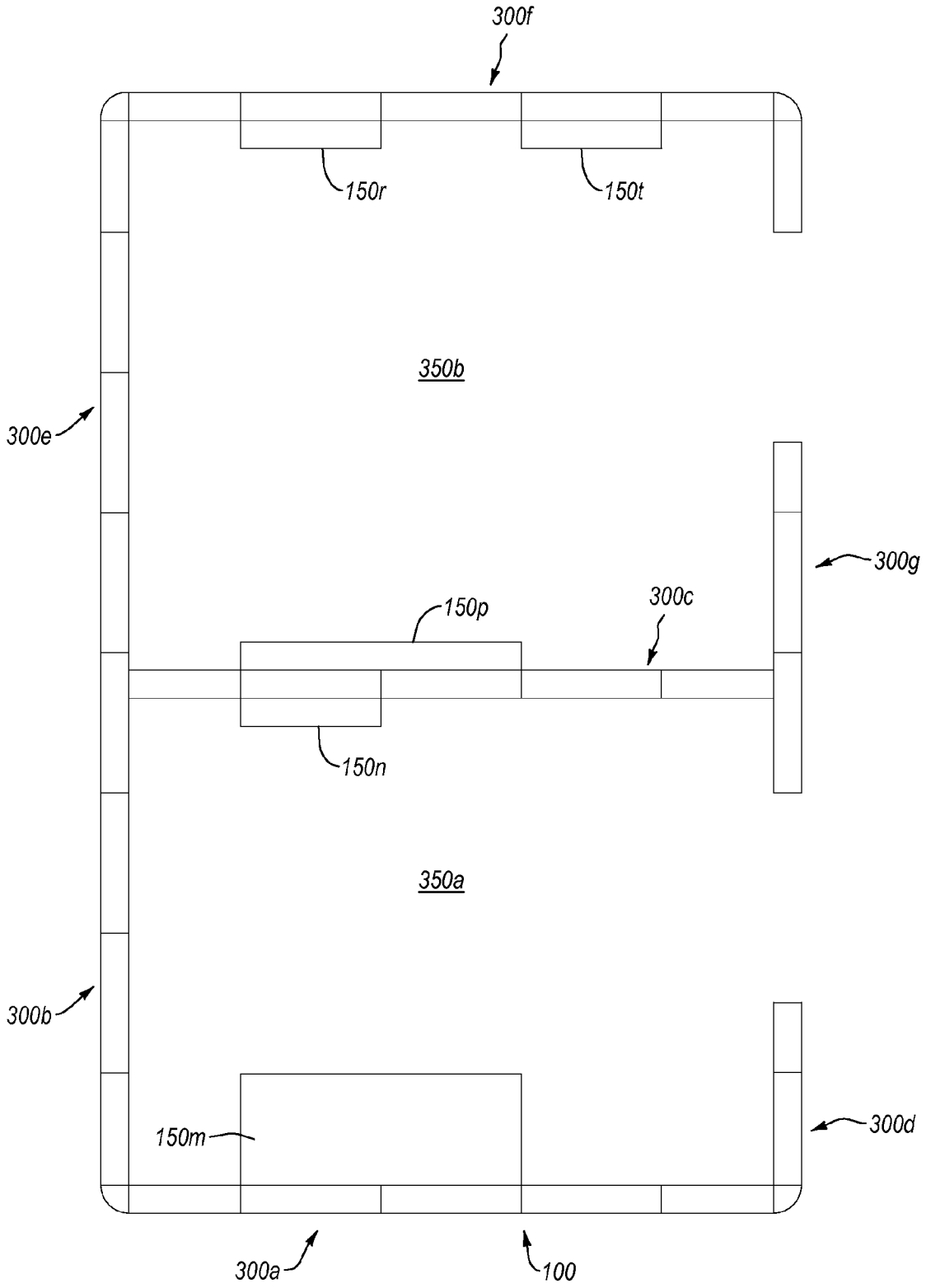
FIG. 6 illustrates a plan view of individual spaces formed by modular walls in accordance with one implementation of the present invention.

FIG. 6 illustrates an exemplary implementation of multiple modular walls that define individual spaces. More specifically, an individual space 350*a* may be formed or defined by modular walls 300*a*, 300*b*, 300*c*, 300*d*, and 300*g*. Similarly, an individual space 350*b* may be formed or defined by modular walls 300*c*, 300*e*, 300*f*, and 300*g*. Except as described herein, any of the modular wall 300*a*, 300*b*, 300*c*, 300*d*, 300*e*, 300*f*, 300*g* and their respective materials, elements, or components may be similar to or the same as the modular wall 300 (FIG. 5) and its respective materials, elements, and component.

As noted above, the individual space 350*a* and the individual space 350*b* may facilitate any number of uses, which may vary from one implementation to another. In one implementation, the individual space 350*a* may be an office space. In one example, the individual space 350*a* may include a movable platform 150*m* (e.g., mounted on the modular wall 300*a*). For instance, the movable platform 150*m* may be a desk or a table, which may span across multiple functional wall modules 100 that may comprise the modular wall 300*a*. In other words, brackets that support the movable platform 150*m* may connect to the frames of different functional wall modules 100 of the modular wall 300*a*.

The individual space 350*a* also may include shelf space, which may be provided by a movable platform 150*n* mounted on the modular wall 300*c*. In at least one implementation, the modular wall 300*c* may incorporate movable platforms on opposing sides thereof. Particularly, the modular wall 300*c* may include the movable platform 150*n* on a first side and a movable platform 150*p* on a second side. Moreover, the movable platform 150*n* may be directly or approximately opposite to the movable platform 150*p*. In one or more implementations, the movable platform 150*n* may have a different size and/or shape than the movable platform 150*p*. Additionally or alternatively, the movable platform 150*n* may have the same or similar size and/or shape as the movable platform 150*p*.

In an implementation, the individual space 350*b* may be a storage or retail space. As such, the individual space 350*b* may include multiple shelving units. For example, the movable platform 150*p* and/or any of movable platforms 150*r*, 150*t* may be shelving units. It should be further appreciated that the individual spaces 350*a*, 350*b* may include any number of movable platforms, which may facilitate any number of uses therefor.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A wall module for at least partially forming an individual space in a building and for positioning and selectively repositioning one or more objects within the individual space, the wall module comprising:

at least two vertical supports positioned on opposite sides of the wall module, the wall module including a front face that is orthogonal to both a first side face and a second side face, wherein at least one of the vertical supports is positioned on the first side face, and at least one of the vertical supports is positioned on the second side face;

one or more horizontal supports connected to at least one of the one or more vertical supports;

one or more brackets each having a connecting portion and a supporting portion that is orthogonal relative to the connecting portion, each connecting portion being slidably connected through at least one vertical support of the at least two vertical supports such that at least one connecting portion extends horizontally outwards from the first side face of the wall module and at least one connecting portion extends horizontally outwards from the second side surface of the wall module, orthogonal to the front face of the wall module, and the supporting portion on each connecting portion extends, at a bend in the bracket, toward the front face, orthogonal to the first and second side faces;

a movable platform connected to or integrated with the supporting portion of the one or more brackets, the movable platform having at least one support surface sized and configured to support the one or more objects; and a positioning mechanism connected to one or more of the one or more brackets or the movable platform, the positioning mechanism being configured to move the one or more brackets and the movable platform.

2. The wall module as recited in claim 1, further comprising one or more panels connected to the frame in a manner that the one or more panels at least partially conceal the positioning mechanism.

3. The wall module as recited in claim 1, wherein the one or more vertical supports include one or more slots, each of the one or more slots being sized and configured to slidably secure a portion of one or more brackets.

4. The wall module as recited in claim 3, wherein the connecting portions of each bracket are slidably secured within the one or more slots.

5. The wall module as recited in claim 1, wherein the positioning mechanism includes one or more actuators having a movable portion and a stationary portion, the movable portion of the one or more actuators being connected to one or more of the one or more brackets or the movable platform.

6. The wall module as recited in claim 5, wherein at least one of the one or more actuators includes a hydraulic cylinder having a cylinder body and a cylinder piston movable relative to the cylinder body, and the cylinder body or the cylinder piston is connected to one or more of the one or more brackets or the movable platform.

7. The wall module as recited in claim 6, further comprising a foot pump that a user can operate to supply pressurized fluid into the hydraulic cylinder(s).

8. The wall module as recited in claim 5, wherein the positioning mechanism includes a power supply configured to activate the one or more actuators.

9. The wall module as recited in claim 5, wherein the one or more actuators are connected to the movable platform and at least partially concealed from a user's view by the movable platform.

10. The wall module as recited in claim 1, wherein the positioning mechanism includes at least one actuator and at least one retractable cable, the at least one actuator being connected to a first end of the at least one retractable cable, the at least one actuator being configured to reduce a free length of the at least one retractable cable, the free length being defined between the first end and a second end of the at least one retractable cable.

11. The wall module as recited in claim 10, wherein the second end of the retractable cable is connected to one or more of the one or more brackets or the movable platform.

12. The wall module as recited in claim 10, wherein the at least one actuator is connected to one or more of the one or more brackets or the movable platform.

13. The wall module as recited in claim 1, wherein the positioning mechanism includes at least one actuator and at least one chain or worm gear.

14. A modular wall for creating an individual space and positioning and repositioning one or more objects within the individual space, the modular wall comprising:

one or more wall modules selectively and detachably connected together, the one or more wall modules including a wall module including:

a frame having at least two vertical supports positioned on opposite sides of the wall module, the wall module including a front face that is orthogonal to both a first side face and a second side face, wherein at least one of the vertical supports is positioned on the first side face, and at least one of the vertical supports is positioned on the second side face;

a first movable platform slidably connected through the first and second side faces of the frame via one or more brackets each having a connecting portion and a supporting portion that is orthogonal relative to the connecting portion, the first movable platform having at least one support surface sized and configured to support the one or more objects;

a cable drive positioning mechanism having a movable portion and a stationary portion, the movable portion being connected to the first movable platform, the cable drive positioning mechanism further including a retractable cable operably connected at or near a side of the first movable platform and rotating about a single pulley that is positioned vertically upward from the side of the first movable platform; and an actuator positioned vertically beneath the side of the first movable platform for raising the first movable platform by retracting the retractable cable and lowering the retractable cable by releasing the retractable cable.

15. The modular wall as recited in claim 14, wherein the one or more wall modules include a wall module without a platform connected to the wall module having the first movable platform.

16. The modular wall as recited in claim 14, wherein the frame includes one or more slots and the movable platform is slidably secured within the one or more slots.

17. The modular wall as recited in claim 14, wherein the one or more wall modules include one or more of a second wall module with a second movable platform or a wall module without a movable platform and at least one of the one or more brackets extends outward between the wall module with the first movable platform and the second wall module or between the wall module with the first movable platform and the wall module without a movable platform.

18. The modular wall as recited in claim 14, further comprising a second horizontal movable platform slidably connected to the wall module having the first movable platform.

19. A reconfigurable individual space including a system for positioning and repositioning one or more objects therein, the individual space comprising:

a first modular wall;

a second modular wall detachably connected to the first modular wall, the second modular wall including one or more functional wall modules comprising:

a frame having at least two vertical supports positioned on opposite sides of the wall module, the wall module including a front face that is orthogonal to both a first side face and a second side face, wherein at least one of the vertical supports is positioned on the first side face, and at least one of the vertical supports is positioned on the second side face;

a movable platform slidably connected to the frame;

one or more brackets each having a connecting portion and a supporting portion that is orthogonal relative to the connecting portion, each connecting portion being slidably connected through a slot along a side of the frame such that at least one connecting portion extends horizontally outwards from the first side face of the second wall module and at least one connecting portion extends horizontally outwards from the second side surface of the wall module, orthogonal to the front face of the second wall module, and the supporting portion on each connecting portion extends, at a bend in the bracket, toward the front face, orthogonal to the first and second side faces; and a positioning mechanism secured near or within the frame, the positioning mechanism being connected to the connecting portion of the one or more brackets such that activation of the positioning mechanism moves the movable platform.

20. The individual space as recited in claim 19, wherein the movable platform includes one or more shelves.

21. The individual space as recited in claim 19, wherein the movable platform includes a desk top.

* * * * *